US005924215A

United States Patent [19]

Goodsell

[11] Patent Number: 5,924,215

[45] Date of Patent: Jul. 20, 1999

[54] COMBINATION HAIR DRYER AND VACUUM

[76] Inventor: Robert L. Goodsell, 650 N. Alder Dr., Chandler, Ariz. 85226

[21] Appl. No.: 09/010,753

[22] Filed: Jan. 22, 1998

[51] Int. Cl.[6] ..... A45D 24/00

[52] U.S. Cl. ..... 34/98

[58] Field of Search ..... 34/96, 97, 98, 34/99, 100; 132/212, 229, 269, 271; 219/222; 392/380, 384; 15/344, 415.1, 422

[56] References Cited

U.S. PATENT DOCUMENTS

| | | | |
|---|---|---|---|
| 4,210,162 | 7/1980 | Dreyer et al. | 132/271 |
| 4,218,608 | 8/1980 | Maroney | 34/97 X |
| 4,254,324 | 3/1981 | Vrtaric | 34/98 X |
| 4,977,690 | 12/1990 | Davis, Jr. | 34/97 X |
| 5,267,372 | 12/1993 | Jones | 15/344 |
| 5,444,215 | 8/1995 | Bauer | 219/222 |

*Primary Examiner*—Henry Bennett

[57] ABSTRACT

A new combination hair dryer and vacuum for permitting the drying of hair and vacuuming of debris with the same device. The inventive device includes a housing has a tubular main member and a handle member. The tubular main member has a hollow interior, and opposite first and second ends each having an opening into the hollow interior of the main member. A motor is disposed in the hollow interior of the main member and mounted to the main member. An impeller is disposed in the hollow interior of the main member, the impeller is rotatably mounted to the motor such that the impeller is rotated by the motor when the motor is energized. The handle member is extended from the main member and has a main portion and a trap portion that defines a hollow compartment. The trap portion of is detachably coupled from the main portion of the handle member. The housing has an opening between the hollow interior of the main member and the compartment of the trap portion of the handle member. A valve member is disposed in the hollow interior of the main member, the valve member is pivotally coupled to the housing to permit selective closing of the opening.

9 Claims, 2 Drawing Sheets

COMBINATION HAIR DRYER AND VACUUM

BACKGROUND OF THE INVENTION

1. Field of the Invention

The present invention relates to hair dryers and more particularly pertains to a new combination hair dryer and vacuum for permitting the drying of hair and vacuuming of debris with the same device.

2. Description of the Prior Art

The use of hair dryers is known in the prior art. More specifically, hair dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair dryers include U.S. Pat. No. 5,267,372; U.S. Pat. No. 4,218,608; PCT Patent No. WO 94/23611—Inventors: Collis et al.; U.S. Pat. No. 1,770,749; U.S. Pat. No. 3,474,224; U.S. Pat. No. 4,254,324; and EPO Patent No. 0 257 606 A2—Inventors: Suka et al.

While these devices fulfill their respective, particular objectives and requirements, the aforementioned patents do not disclose a new combination hair dryer and vacuum. The inventive device includes a housing has a tubular main member and a handle member. The tubular main member has a hollow interior, and opposite first and second ends each having an opening into the hollow interior of the main member. A motor is disposed in the hollow interior of the main member and mounted to the main member. An impeller is disposed in the hollow interior of the main member, the impeller is rotatably mounted to the motor such that the impeller is rotated by the motor when the motor is energized. The handle member is extended from the main member and has a main portion and a trap portion that defines a hollow compartment. The trap portion of is detachably coupled from the main portion of the handle member. The housing has an opening between the hollow interior of the main member and the compartment of the trap portion of the handle member. A valve member is disposed in the hollow interior of the main member, the valve member is pivotally coupled to the housing to permit selective closing of the opening.

In these respects, the combination hair dryer and vacuum according to the present invention substantially departs from the conventional concepts and designs of the prior art, and in so doing provides an apparatus primarily developed for the purpose of permitting the drying of hair and vacuuming of debris with the same device.

SUMMARY OF THE INVENTION

In view of the foregoing disadvantages inherent in the known types of hair dryers now present in the prior art, the present invention provides a new combination hair dryer and vacuum construction wherein the same can be utilized for permitting the drying of hair and vacuuming of debris with the same device.

The general purpose of the present invention, which will be described subsequently in greater detail, is to provide a new combination hair dryer and vacuum apparatus and method which has many of the advantages of the hair dryers mentioned heretofore and many novel features that result in a new combination hair dryer and vacuum which is not anticipated, rendered obvious, suggested, or even implied by any of the prior art hair dryers, either alone or in any combination thereof.

To attain this, the present invention generally comprises a housing has a tubular main member and a handle member. The tubular main member has a hollow interior, and opposite first and second ends each having an opening into the hollow interior of the main member. A motor is disposed in the hollow interior of the main member and mounted to the main member. An impeller is disposed in the hollow interior of the main member, the impeller is rotatably mounted to the motor such that the impeller is rotated by the motor when the motor is energized. The handle member is extended from the main member and has a main portion and a trap portion that defines a hollow compartment. The trap portion of is detachably coupled from the main portion of the handle member. The housing has an opening between the hollow interior of the main member and the compartment of the trap portion of the handle member. A valve member is disposed in the hollow interior of the main member, the valve member is pivotally coupled to the housing to permit selective closing of the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination hair dryer and vacuum apparatus and method which has many of the advantages of the hair dryers mentioned heretofore and many novel features that result in a new combination hair dryer and vacuum which is not anticipated, rendered obvious, suggested, or even implied by any of the prior art hair dryers, either alone or in any combination thereof.

It is another object of the present invention to provide a new combination hair dryer and vacuum which may be easily and efficiently manufactured and marketed.

It is a further object of the present invention to provide a new combination hair dryer and vacuum which is of a durable and reliable construction.

An even further object of the present invention is to provide a new combination hair dryer and vacuum which is susceptible of a low cost of manufacture with regard to both materials and labor, and which accordingly is then susceptible of low prices of sale to the consuming public, thereby making such combination hair dryer and vacuum economically available to the buying public.

Still yet another object of the present invention is to provide a new combination hair dryer and vacuum which provides in the apparatuses and methods of the prior art some of the advantages thereof, while simultaneously overcoming some of the disadvantages normally associated therewith.

Still another object of the present invention is to provide a new combination hair dryer and vacuum for permitting the drying of hair and vacuuming of debris with the same device.

Yet another object of the present invention is to provide a new combination hair dryer and vacuum which includes a housing has a tubular main member and a handle member. The tubular main member has a hollow interior, and opposite first and second ends each having an opening into the hollow interior of the main member. A motor is disposed in the hollow interior of the main member and mounted to the main member. An impeller is disposed in the hollow interior of the main member, the impeller is rotatably mounted to the motor such that the impeller is rotated by the motor when the motor is energized. The handle member is extended from the main member and has a main portion and a trap portion that defines a hollow compartment. The trap portion of is detachably coupled from the main portion of the handle member. The housing has an opening between the hollow interior of the main member and the compartment of the trap portion of the handle member. A valve member is disposed in the hollow interior of the main member, the valve member is pivotally coupled to the housing to permit selective closing of the opening.

Still yet another object of the present invention is to provide a new combination hair dryer and vacuum that is especially advantageous to hair stylists and barbers by providing them with a convenient apparatus that lets them blow dry hair and vacuum hair cuttings from their work area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
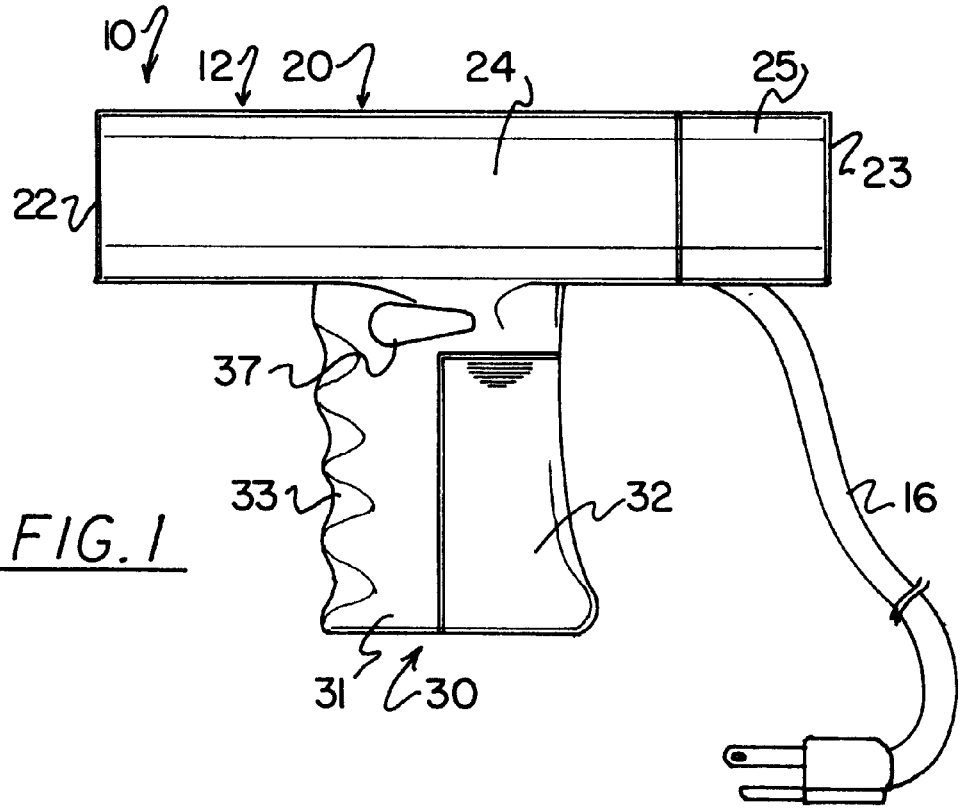
FIG. 1 is a schematic side view of a new combination hair dryer and vacuum according to the present invention.
Figure 2:
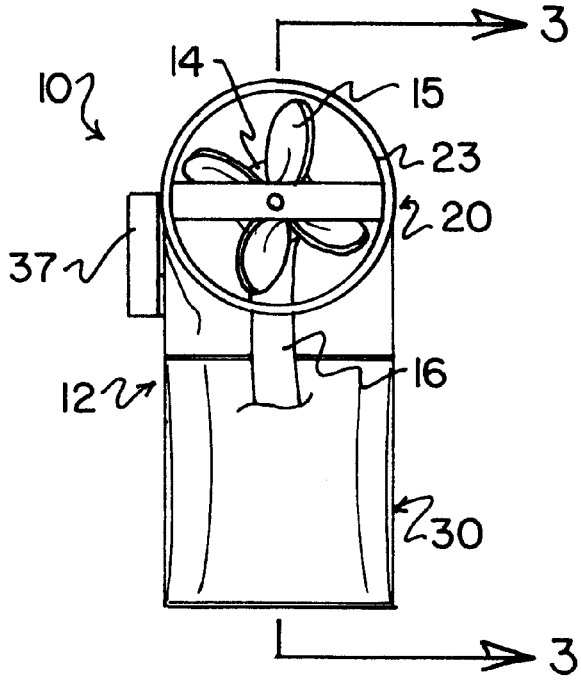
FIG. 2 is a schematic side view of the second end side of the present invention.
Figure 3:
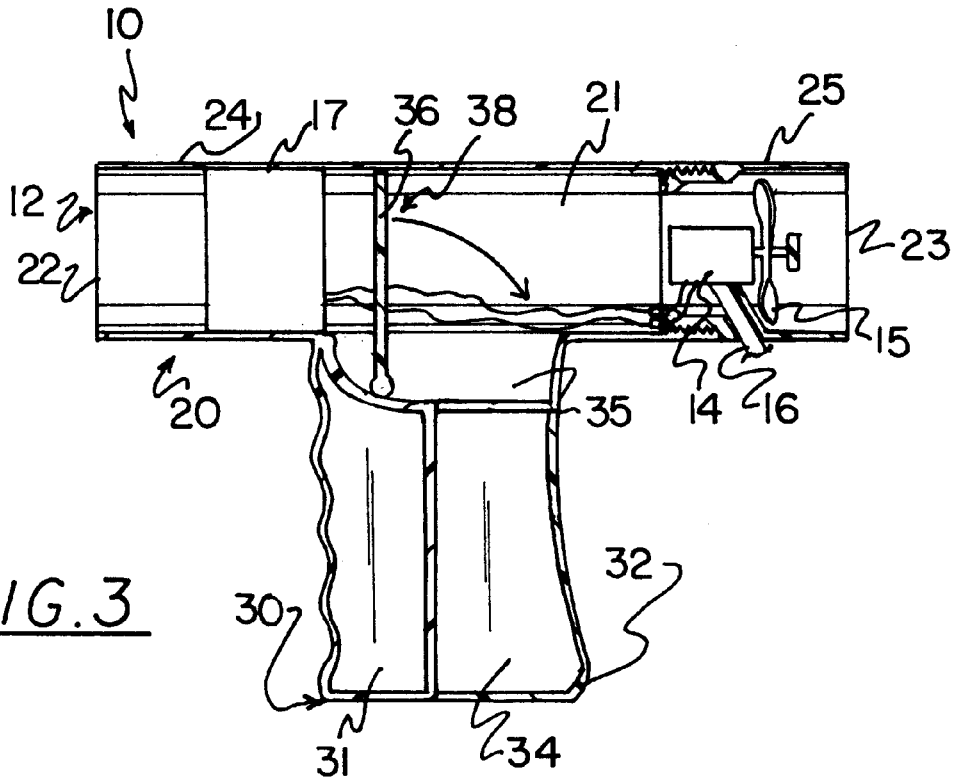
FIG. 3 is a schematic cross sectional view of the present invention taken from line 3—3 on FIG. 2.
Figure 4:
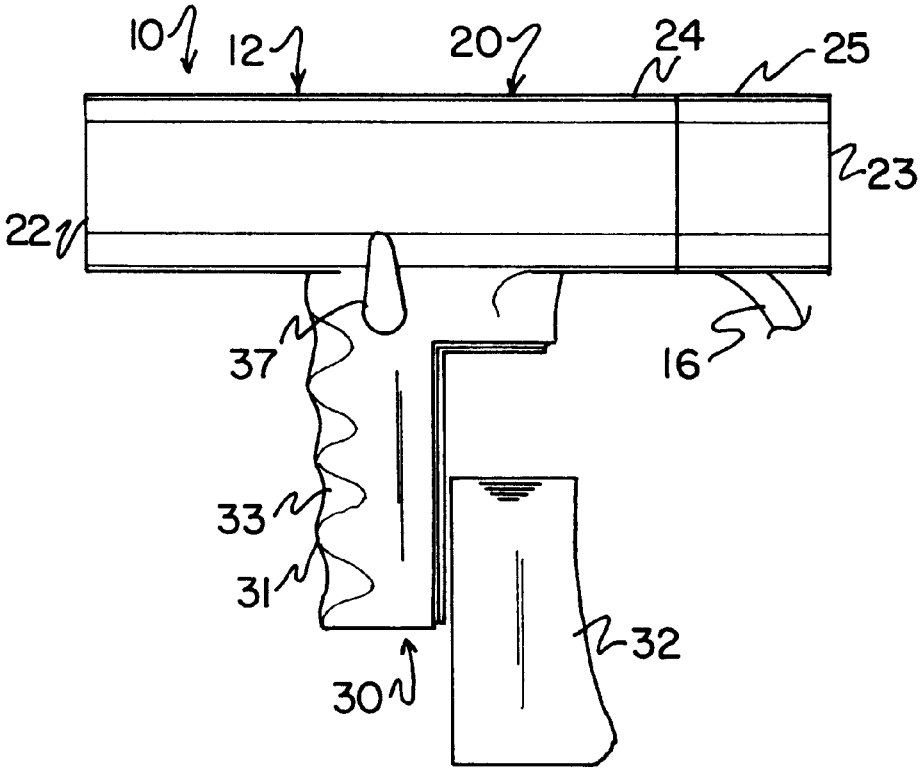
FIG. 4 is a schematic side view of the present invention showing the detachment of the trap portion of the handle member.

With reference now to the drawings, and in particular to FIGS. 1 through 4 thereof, a new combination hair dryer and vacuum embodying the principles and concepts of the present invention and generally designated by the reference numeral 10 will be described.

As best illustrated in FIGS. 1 through 4, the combination hair dryer and vacuum 10 generally comprises a housing 12 has a tubular main member 20 and a handle member 30. The tubular main member 20 has a hollow interior 21, and opposite first and second ends 22,23 each having an opening into the hollow interior 21 of the main member 20. A motor 14 is disposed in the hollow interior 21 of the main member 20 and mounted to the main member 20. An impeller 15 is disposed in the hollow interior 21 of the main member 20, the impeller 15 is rotatably mounted to the motor 14 such that the impeller 15 is rotated by the motor 14 when the motor 14 is energized. The handle member 30 is extended from the main member 20 and has a main portion 31 and a trap portion 32 that defines a hollow compartment 34. The trap portion 32 of is detachably coupled from the main portion 31 of the handle member 30. The housing 12 has an opening 35 between the hollow interior 21 of the main member 20 and the compartment 34 of the trap portion 32 of the handle member 30. A valve member 36 is disposed in the hollow interior 21 of the main member 20, the valve member 36 is pivotally coupled to the housing 12 to permit selective closing of the opening 35.

In closer detail, the apparatus 10 permits a user to use the device for selectively blowing air and vacuuming debris. The housing 12 has a tubular main member 20 and a handle member 30. The tubular main member 20 is generally cylindrical and has a hollow interior 21, and opposite first and second ends 22,23 each having an opening into the hollow interior 21 of the main member 20. Preferably, the main member 20 has generally cylindrical first and second portions 24,25 with the first portion 38 located towards the first end 22 of the main member 20 and the second portion 25 located towards the second end 23 of the main member 20. Ideally, the second portion 25 is threadably detachable from the first portion 24 for easy cleaning of the second portion 25.

The motor 14 has a rotatable shaft and is disposed in the hollow interior 21 of the main member 20 and mounted to the second portion 25. The motor 14 is connectable to a power source by an electric cord 16. The impeller 15 is disposed in the hollow interior 21 of the second portion 25 of the main member 20 and is rotatably mounted to rotatable shaft of the motor 14 such that the impeller 15 is rotated by the motor 14 when the motor 14 is energized. The impeller 15 is designed for moving air through the hollow interior 21 of the main member 20 from the second end 23 of the main member 20 towards the first end 22 of the main member 20 when rotated. A heating element 17 is provided within the hollow interior 21 of the main member 20 and is designed for heating air in the hollow interior 21 of the main member 20.

The handle member 30 is downwardly extended from the first portion 24 of the main member 20 and a main portion 31 and a trap portion 32. The trap portion 32 of is detachably coupled from the main portion 31 of the handle member 30. The trap portion 32 defines a hollow compartment 34 which is designed for holding debris therein. Optionally, the main portion 31 of the handle member 30 has a plurality of finger indentations for aiding gripping of the handle member 30. The housing 12 also has an opening between the hollow interior 21 of the first portion 24 of the main member 20 and the compartment 34 of the trap portion 32 of the handle member 30 such that the hollow interior 21 of the first portion 24 of the main member 20 is in fluid communication with the compartment 34 of the trap portion 32 of the handle member 30.

The valve member 36 is disposed in the hollow interior 21 of the main member 20 and is located in the first portion 24 of the main member 20. The valve member 36 is pivotally coupled to the handle member 30 of the housing 12 such that the valve member 36 is pivotable between a first position 38 and a second position. When the valve member 36 is in the first position 38, or hair blowing position, the valve member 36 substantially closes the opening between the hollow interior 21 of the main member 20 and the compartment 34 of the trap portion 32 such that air passing from the second end 23 of the main member 20 into the hollow interior 21 of the main member 20 exits from the first end 22 of the main member 20. This position 38 permits the use of the apparatus as a hair dryer.

When the valve member 36 is in the second position (not shown), or vacuuming position, the valve member 36 substantially blocks the hollow interior 21 of the main member 20 such that debris passing from the second end 23 of the main member 20 into the hollow interior 21 of the main member 20 is diverted into the compartment 34 of the trap portion 32. This permits the apparatus 10 to be used as a vacuum with the second end 23 of the main member 20 functioning as an intake.

The valve member 36 preferably has a lever 37 that is outwardly extended from the handle member 30 of the housing 12. The lever 37 is operatively connected to the valve member 36 such that the lever 37 permits selective positioning of the valve member 36 between the first position 38 and the second position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for selectively blowing air and vacuuming debris, comprising:

a housing having a tubular main member and a handle member;

said tubular main member having a hollow interior, opposite first and second ends, each of said ends of said main member having an opening into said hollow interior of said main member;

a motor being disposed in said hollow interior of said main member and mounted to said main member;

an impeller being disposed in said hollow interior of said main member, said impeller being rotatably mounted to said motor such that said impeller is rotated by said motor when said motor is energized;

said handle member being extended from said main member, said handle member having an interior, a main portion and a trap portion, said trap portion defining a hollow compartment, said hollow compartment being for holding debris therein, said trap portion of being detachably coupled from said main portion of said handle member;

said housing having an opening between said hollow interior of said main member and said compartment of said trap portion of said handle member; and a valve member being disposed in said hollow interior of said main member, said valve member being pivotally coupled to said housing.

2. The apparatus of claim 1, wherein said main member has first and second portions said first portion being located towards said first end of said main member, said second portion of said main member being located towards said second end of said main member, said second portion of said main member being detachable from said first portion of said main member.

3. The apparatus of claim 2, wherein said second portion of said main member is threadably detachable from said first portion of said main member.

4. The apparatus of claim 2, wherein said motor is mounted to said second portion of said main member.

5. The apparatus of claim 2, wherein said impeller is disposed in said hollow interior of said second portion of said main member.

6. The apparatus of claim 2, wherein said handle member is extended from said first portion of said main member.

7. The apparatus of claim 2, wherein said valve member is located in said first portion of said main member.

8. The apparatus of claim 1, wherein said valve member has a lever being outwardly extended from said handle member of said housing, said lever being operatively connected to said valve member such that said lever permits selective pivoting of said valve member.

9. An apparatus for selectively blowing air and vacuuming debris, comprising:

a housing having a tubular main member and a handle member;

said tubular main member being generally cylindrical and having a hollow interior, opposite first and second ends, each of said ends of said main member having an opening into said hollow interior of said main member;

said main member having generally cylindrical first and second portions, said first portion being located towards said first end of said main member, said second portion of said main member being located towards said second end of said main member, said second portion of said main member being threadably detachable from said first portion of said main member;

a motor and being disposed in said hollow interior of said main member and mounted to said second portion of said main member;

an impeller being disposed in said hollow interior of said second portion of said main member, said impeller being rotatably mounted to said motor such that said impeller is rotated by said motor when said motor is energized, said impeller being for moving air through said hollow interior of said main member from said second end of said main member towards said first end of said main member when rotated;

said handle member being extended from said first portion of said main member, said handle member having an interior, a main portion and a trap portion, said main portion of said handle member having a plurality of finger indentations, said trap portion defining a hollow compartment, said hollow compartment being for holding debris therein, said trap portion of being detachably coupled from said main portion of said handle member;

said housing having an opening between said hollow interior of said first portion of said main member and said compartment of said trap portion of said handle member;

a valve member being disposed in said hollow interior of said main member, said valve member being located in said first portion of said main member, said valve member being pivotally coupled to said housing such that said valve member is pivotable between a first position and a second position;

wherein said valve member substantially closes said opening between said hollow interior of said main member and said compartment of said trap portion when said valve member is in said first position such that air passing from said second end of said main member into said hollow interior of said main member exits from said first end of said main member;

wherein said valve member substantially blocks said hollow interior of said main member when said valve member is in said second position such that debris passing from said second end of said main member into said hollow interior of said main member is diverted into said compartment of said trap portion; and said valve member having a lever being outwardly extended from said handle member of said housing, said lever being operatively connected to said valve member such that said lever permits selective pivoting of said valve member between said first position and said second position.

* * * * *